United States Patent [19]

Wells et al.

[11] Patent Number: 4,478,111

[45] Date of Patent: Oct. 23, 1984

[54] SUSPENSION OF ADJUSTABLE PIPE SPINNER

[75] Inventors: Lawrence E. Wells, Anaheim; Boris Kamenster; Preston R. Fox, both of Fountain Valley, all of Calif.; Jerry A. Gill, Spring, Tex.

[73] Assignee: Varco International, Inc., Orange, Calif.

[21] Appl. No.: 376,745

[22] Filed: Aug. 29, 1982

[51] Int. Cl.[3] ..... B25B 13/50

[52] U.S. Cl. ..... 81/57.19; 81/57.2; 81/57.24; 81/57.35; 81/57.4

[58] Field of Search ..... 81/57.24, 57.35, 57.4, 81/57.2, 57.15, 177 A, 177 E, 177 N, 177 ST, 177 B, 177 D, 177 PP

[56] References Cited

U.S. PATENT DOCUMENTS

| | | | |
|---|---|---|---|
| 2,524,508 | 10/1950 | Barnes | 81/177 PP |
| 2,550,045 | 4/1951 | DeHetre | 81/57.24 |
| 2,556,536 | 6/1951 | Harris | 81/57.24 |
| 4,099,429 | 7/1978 | Hauk | 81/57.2 |
| 4,425,827 | 1/1984 | Wells | 81/57 |

*Primary Examiner*—James L. Jones, Jr.
*Attorney, Agent, or Firm*—William P. Green

[57] ABSTRACT

A well pipe spinner includes two body parts carrying rollers and mounted by two pivotal connections for swinging movement between a closed position in which the rollers grip and drive a well pipe and an open position releasing the pipe. A structure extends between and interconnects the two pivotal connections in a relation permitting relative adjustment of their pivotal axes toward and away from one another for gripping different sizes of pipe. The tool is supported by a structure which is adapted to be suspended from a line or other element and which suspends the two body parts and pivotal connections at essentially the locations of the two pivotal axes.

19 Claims, 6 Drawing Figures

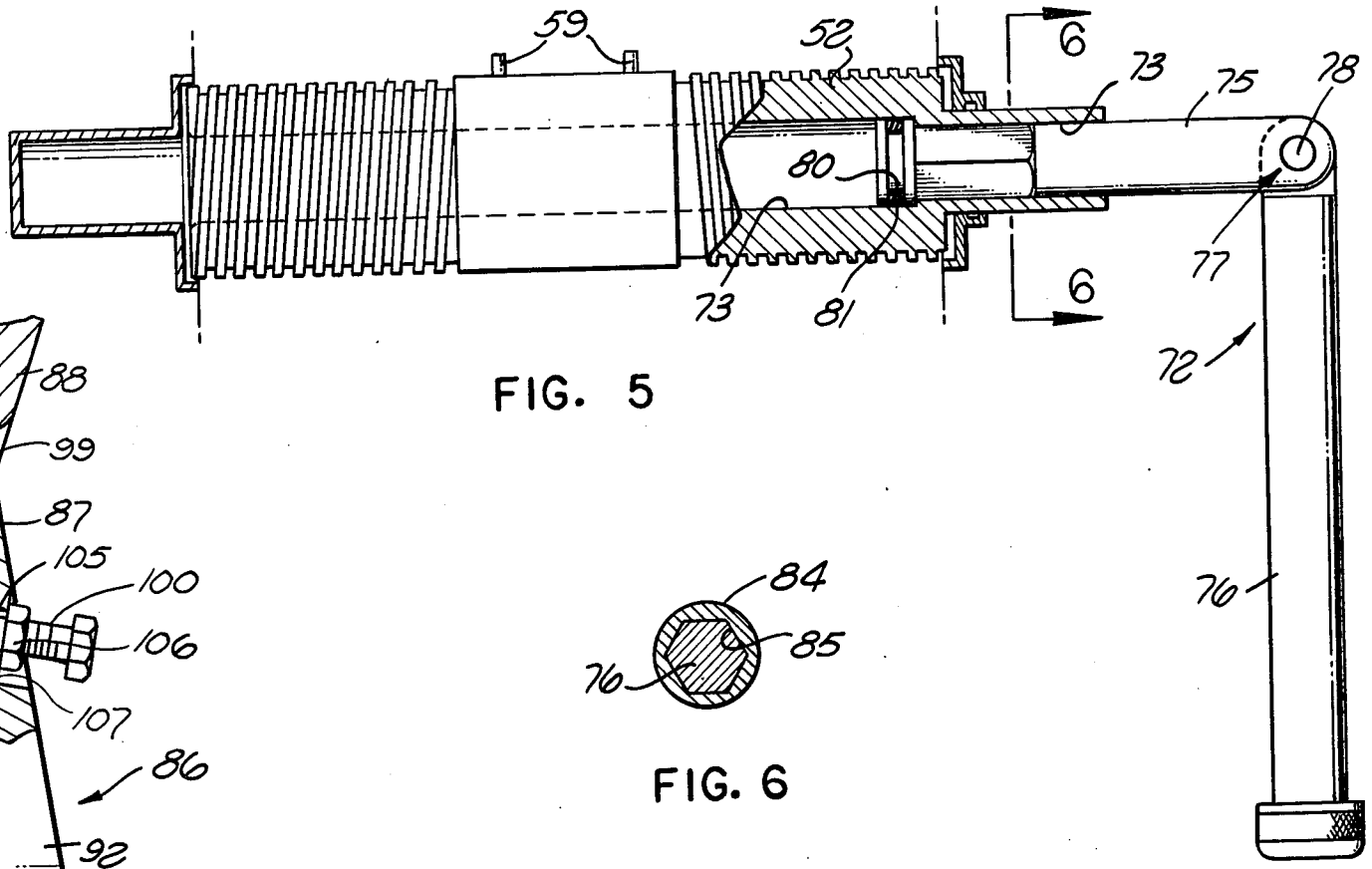
FIG. 5
FIG. 6
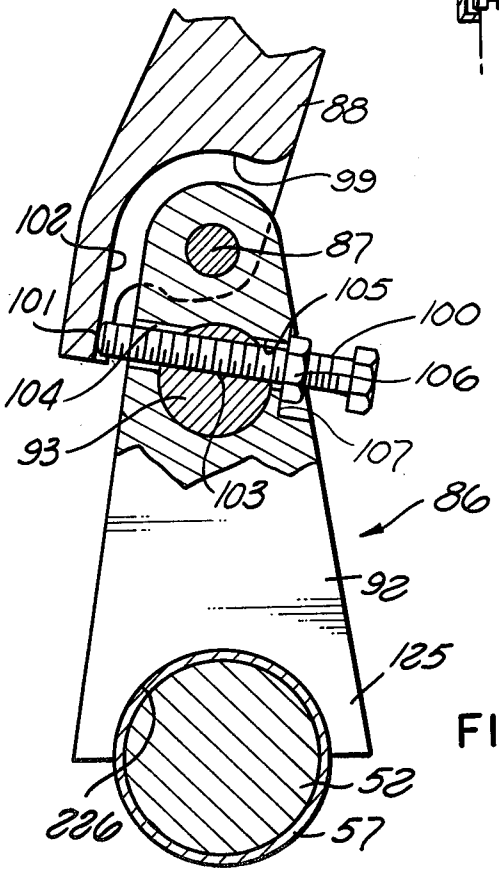
FIG. 3

SUSPENSION OF ADJUSTABLE PIPE SPINNER

BACKGROUND OF THE INVENTION

This invention relates to improved well pipe spinning tools for rotating a first pipe section rapidly relative to another pipe section to screw them into or out of threaded engagement.

Two prior copending application Ser. Nos. 6/257,105 filed Apr. 24, 1981 by Boyadjieff et al. on "Pipe Spinning Tool", now U.S. Pat. No. 4,446,761, and Ser. No. 351,462 filed Feb. 23, 1982 by Lawrence E. Wells on "Suspension of Pipe Spinner", now U.S. Pat. No. 4,425,827 disclose a type of pipe spinner including two body parts carrying rollers and mounted for swinging movement about two different pivotal axes respectively to move the rollers toward and away from one another and into and out of driving engagement with a well pipe. At least one and preferably all of the rollers are power driven to frictionally drive the pipe rotatively in order to spin it into and out of threaded engagement with another pipe section. An adjustable connection attaches the two pivotal connections together in a manner enabling their pivotal axes to be adjusted toward and away from one another to adjust the spinner for effective driving engagement with different sizes of pipe. This adjustable connection may include two nuts having right and left-hand threads respectively and engaging corresponding right and left-hand threads on a rotary adjusting shaft which acts when turned to shift the nuts and the associated pivotal connections and body members relatively toward and away from one another.

SUMMARY OF THE INVENTION

A major purpose of the present invention is to provide an improved arrangement for suspending the weight of a tool similar to those of the above discussed prior applications in a manner maintaining proper balance of the tool in a predetermined desirably level orientation in all of the various conditions to which the tool may be adjusted, and allowing for positive powered actuation of the rollers against the pipe and effective rotation of the pipe by the rollers in those different adjusted conditions. In addition, the suspension is such as to allow for adjustment of the two pivotal axes relatively toward and away from one another with minimum actuating force.

To attain optimum suspension of the tool, it is supported by a structure which is adapted to be connected to a suspending line or other element and which has portions extending toward the locations of the two relatively adjustable pivotal axes, with those portions acting to suspend the two pivoting body members and the two pivotal connections at essentially the locations of those axes. As the two axes are adjusted toward or away from one another, these points of support move with the axes, so that in all of the adjusted positions of the pivotal connections the support remains at essentially the locations of the two axes. The arrangement is such that the support member suspends the tool at essentially the locations of these axes without transmission of the suspension forces through the discussed adjusting screw or other element or elements of the adjustable connection extending between the two pivotal connections. Preferably, the suspending mechanism includes a hanger element having projections extending in different directions toward the two pivotal axes, at locations offset from and desirably above the adjusting screw or its equivalent, with those projections movably carrying parts which suspend the two body members and their pivotal connections. These parts may shift longitudinally along the projections during and in correspondence with the discussed relative adjusting movement of the two axes. To maintain the body members and carried parts, when suspended, in a proper horizontally extending level orientation, the hanger structure may have a portion whose movement is restricted by the adjusting screw, or other portion of the adjustable connection extending between the two pivotal connections, in a relation preventing tilting movement of the body parts about a horizontal axis from that level condition.

BRIEF DESCRIPTION OF THE DRAWINGS

The above and other features and objects of the invention will be better understood from the following detailed description of the typical embodiment illustrated in the accompanying drawings in which:

FIG. 3 is an enlarged fragmentary vertical section taken on line 3—3 of FIG. 2;

FIG. 5 is a reduced scale view corresponding to a portion of FIG. 4 and showing the adjusting handle in its active position; and FIG. 6 is a fragmentary transverse section taken on line 6—6 of FIG. 5.

DESCRIPTION OF THE PREFERRED EMBODIMENT

Figure 1:
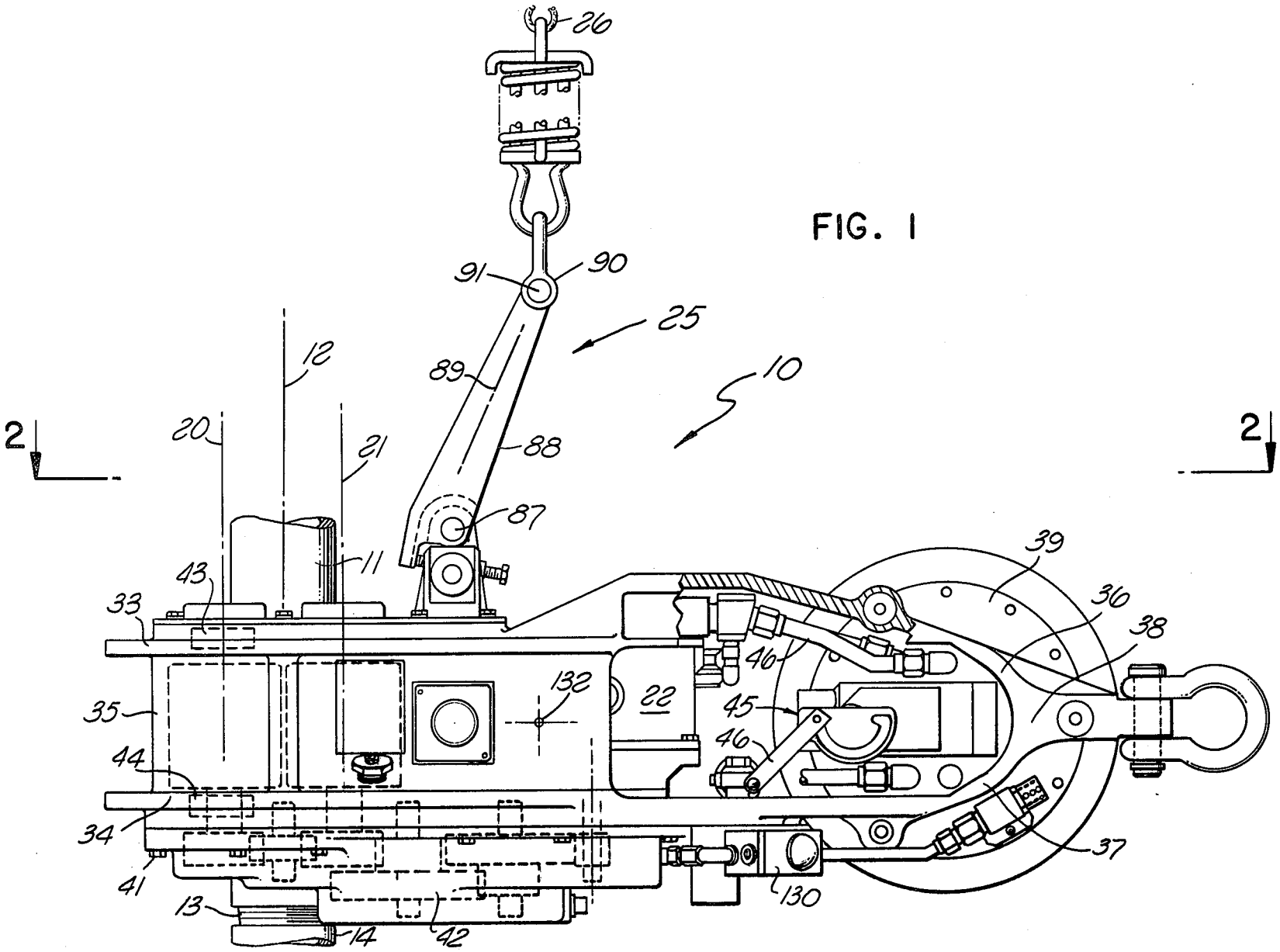
FIG. 1 is a side elevational view of a spinner embodying the invention.
Figure 2:
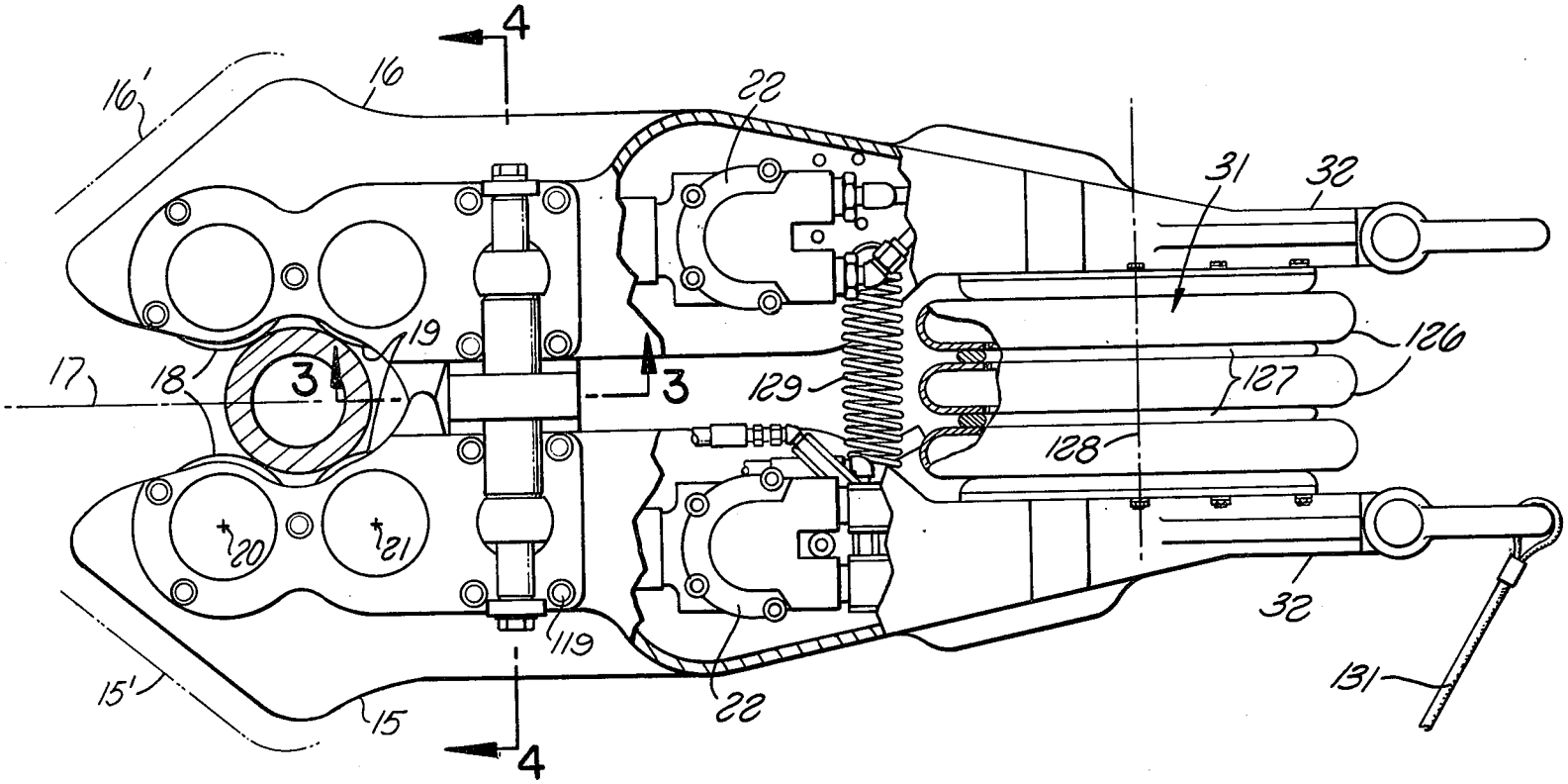
FIG. 2 is primarily a plan view of the spinner, taken on line 2—2 of FIG. 1.

The spinner 10 shown in the drawings is adapted to be suspended as illustrated in FIGS. 1 and 2 for engagement with a vertical well pipe section 11, and acts to spin that pipe section rapidly about the vertical axis 12 of the well to either connect the lower threaded end 13 of section 11 to the next lower section 14 of a drill string or other string of well pipe, or to spin section 11 out of threaded engagement with section 14. Tool 10 includes two body halves 15 and 16 which may be essentially mirror images of one another with respect to a vertical central plane 17 of the tool extending through axis 12. Each of the body halves 15 and 16 carries two externally cylindrical rollers 18 and 19 (FIG. 2), which are driven rotatively relative to the corresponding body section 15 or 16 and about two vertical axes 20 and 21, with two motors 22 being carried by the body sections 15 and 16 respectively and acting to drive the rollers to turn an engaged well pipe.

Body section 15 and its carried rollers and motor are mounted by a pivotal connection 23 (FIG. 4) for swinging movement about a vertical axis 24 relative to a hanger assembly 25 by which the tool is suspended from a flexible line or other suspending member 26 attached to the rig derrick. A second pivotal connection 27 mounts the second body section 16 for pivotal movement about another vertical axis 28 relative to hanger assembly 25 and relative to section 15. These pivotal connections thus mount the two body sections and carried rollers for swinging movement between open positions represented in broken lines at 15' and 16' in FIG.

2, in which positions the rollers are out of engagement with the well pipe and the tool can be moved into and out of active position about the pipe, and the full line active position of FIG. 2 in which the rollers engage and tightly grip the pipe to turn it rotatively.

To enable adjustment of the tool for engagement with pipes of different sizes, the two pivotal connections 23 and 27 are joined together by an adjustable connection 29 enabling the pivotal connections and their axes 24 and 28 to be shifted toward and away from one another along a transverse axis 30 which is perpendicular to plane 17. In any of the various settings of pivotal connections 23 and 27 relative to one another, the body sections can be pivoted about their individual axes 24 and 28 in directions to bring their left ends as viewed in FIG. 2 toward one another and against the pipe, with this gripping actuation of the body members and rollers being effected by a fluid pressure operated actuating unit 31 interposed between and acting to forceably spread apart the right end portions 32 of body sections 15 and 16.

Each of the body sections 15 and 16 may be formed primarily of a rigid metal casting having vertically spaced horizontal and parallel top and bottom walls 33 and 34 (FIG. 4) joined near their left ends as viewed in FIG. 1 by vertical walls 35, and joined at their right ends by portions 36 and 37 which merge together at 38 and carry circular end plates 39 of the fluid pressure actuated assembly 31. A hollow gear housing 40 may be connected to the underside of each of the body sections 15 and 16, as by bolts or other fasteners represented at 41, to contain a gear train 42 for turning the rollers.

Each of the drive motors 22 is mounted to one of the body sections 15 or 16, and is received between top and bottom walls 33 and 34 of that section. The driven shaft of the motor projects downwardly beneath bottom wall 34 and acts through gear train 42 to drive rollers 18 and 19 rotatively in a common direction about their vertical axis 20 and 21. The rollers are mounted for such rotation relative to body sections 15 or 16 by upper and lower bearings represented diagrammatically at 43 and 44. This entire drive mechanism is duplicated for each of the body halves and carried rollers, with the gear mechanism functioning as a reduction gear assembly acting to turn the rollers at a speed substantially slower than the speed of rotation of the motor. The two rotary motors are preferably fluid driven, either hydraulically or pneumatically, under the control of a manually actuated reversing valve represented at 45 in FIG. 1, whose actuating handle 46 is movable between a central off position in which no fluid is supplied to the motors and they do not turn, a second position in which fluid is supplied to both of the motors to turn them in a first direction for spinning pipe 11 in one direction, and a third position in which fluid is supplied to the motors to turn them in the opposite direction to reverse the direction of drive of the well pipe. Valve 45 is carried by one of the two body sections 15 and 16, and is connected to the two motors by appropriate fluid supply and exhaust lines 46 which include flexible hoses extending to the motor of the other body section to avoid interference by the fluid lines with the previously discussed relative movement of the sections.

Figure 4:
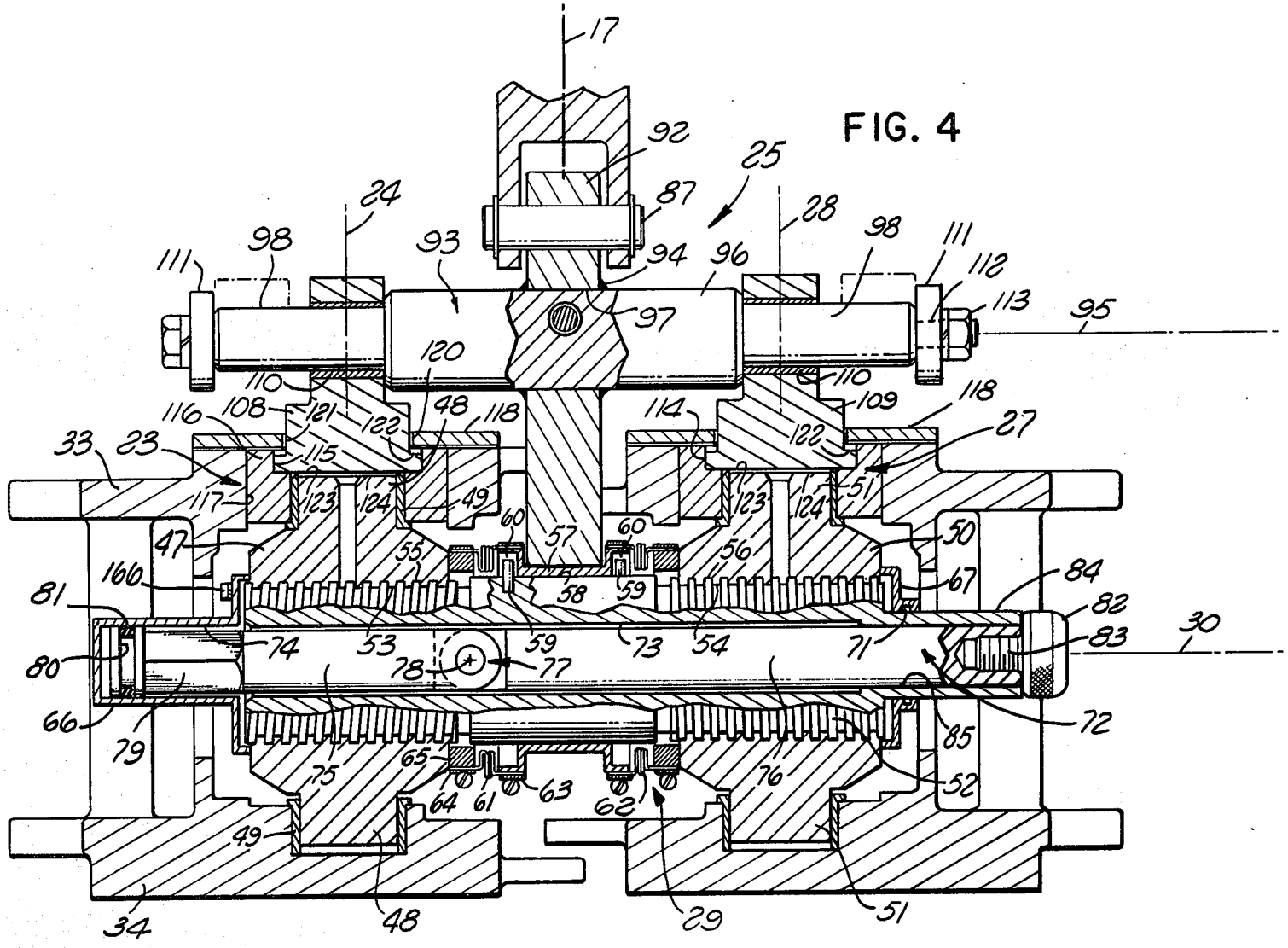
FIG. 4 is an enlarged fragmentary transverse vertical section taken on line 4—4 of FIG. 2.

Referring now to FIG. 4, the pivotal connection 23 which mounts body part 15 for pivotal movement about axis 24 may include a nut element 47 having aligned upper and lower stub shaft portions 48 journalled within bushings 49 carried by body section 15 to mount the body section for the desired pivotal movement about axis 24 relative to element 47. The second pivotal connection 27 similarly includes a nut element 50 having upper and lower stub shafts 51 journalled in body section 16 to mount that section for pivotal movement relative to element 50.

The adjustable connection 29 which permits relative shifting movement of the two pivotal connections 23 and 27 may include a threaded adjusting shaft 52 extending along and centered about transverse axis 30, and include portions of nut elements 47 and 50 containing internal right and left-hand threads 53 and 54 respectively engaging two sets of right and left-hand threads 55 and 56 formed on opposite ends of the shaft. A tubular bushing 57 is carried about and rotatable relative to a central unthreaded portion 58 of the shaft, and is retained against axial movement relative thereto by pins 59 carried by and projecting radially outwardly from the shaft into annular recesses 60 formed in the opposite ends of the bushing 57.

As will be understood, rotation of the shaft 52 in one direction acts by virtue of the right-hand and left-hand threads to move nut elements 47 and 50 relatively toward one another while rotation of the shaft in the opposite direction moves the nut elements away from one another. Seals may be provided axially between each of the nut elements and the intermediate bushing 57 by a pair of annular axially extensible bellows 61 and 62 each having one of its ends secured to and about bushing 57 by an annular clamp 63 and its other end secured by an annular clamp 64 to a ring 65 welded or otherwise attached to a corresponding one of the nut elements. Seals may be provided at the other ends of the two sets of threads by an end plate 66 attached by screws 166 to nut element 47 and an annular seal member 67 secured to nut element 50 and sealed to the shaft by an O-ring 71.

The threaded shaft 52 may be tubular, and be adapted to be rotated by an inner shaft assembly 72 which is adapted to be withdrawn from the inactive retracted position shown in FIG. 4 to the active position shown in FIG. 5. This inner shaft assembly 72 is received within a bore 73 formed in the threaded shaft 52, and in the FIG. 4 condition projects leftwardly into a bore 74 which is formed in end cap 66 and is of a diameter corresponding to passage 73 in the screw shaft. Assembly 72 may be formed sectionally to include a first part 75 and an axially outer handle portion 76 attached by a hinge connection 77 to inner part 75 for relative pivotal movement about an axis 78 extending transversely of and intersecting axis 30. Part 75 has an externally hexagonal portion 79 near its left end as viewed in FIGS. 4 and 5, and may have an annular groove 80 beyond hexagonal portion 78 containing a rubber O-ring 81 engageable with bores 73 and 74 to frictionally retain the inner shaft assembly 72 in either the FIG. 4 position or FIG. 5 position.

At its right end as viewed in FIG. 4, the inner shaft assembly 72 may carry an externally knurled knob 82, connected threadedly to part 76 at 83 and adapted to be grasped by an operator to facilitate axial withdrawal of assembly 72 from the inactive FIG. 4 position to the active FIG. 5 position.

At its right end, the threaded shaft 52 has a portion 84 whose outer cylindrical surface is engageable with the previously mentioned seal ring 71 carried by part 67, and whose internal surface 85 is of hexagonal cross-section corresponding to the hex portion 79 of part 75.

When assembly 72 is to be utilized for adjusting threaded shaft 52, assembly 72 is pulled rightwardly from the FIG. 4 position to the FIG. 5 position in which hexagonal portion 79 of part 75 is received within hexagonal passage 85 in threaded shaft 52 to transmit rotation from part 75 to shaft 52. The handle part 76 is swung through ninety degrees to the position illustrated in FIG. 5, and can then be used to rotate part 75 and shaft 52 and thereby adjust the body parts of the tool for gripping a pipe of any desired size.

The hanger assembly 25 by which the spinner is suspended in a rig may include a first hanger element 86 (FIGS. 1 and 3) pivotally connected by a horizontal pin 87 to an upper or second hanger element 88 taking the form of a rigid arm extending upwardly along an inclined axis 89 to an upper connecting portion 90 containing an opening or other means by which part 88 is attached at a suspension point 91 to line 26 hanging from the upper end of the rig derrick. The lower hanger element 86 may be formed of two parts 92 and 93 welded rigidly together at 94 (FIG. 4). The first of these parts 92 may be a rigid metal plate extending vertically above the central unthreaded portion 58 of adjusting shaft 52 and having its central vertical plane coincident with the previously mentioned central vertical plane 17 of the tool. The second part 93 may be formed as a rigid metal rod extending along a transverse axis 95, and having a central relatively large diameter portion 96 received within an opening 97 in part 92 and welded thereto, with reduced diameter externally cylindrical portions 98 of shaft or rod 93 projecting in opposite directions along axis 95 to positions above the two nut elements 47 and 50. As will be apparent from FIG. 4, the horizontal axis 95 of rod 93 is parallel to and offset above axis 30 of adjusting shaft 52, lies in the same vertical plane as axis 30, and intersects the vertical axes 24 and 28 of the pivotal connections formed by portions 48 and 51 of the nut elements.

Referring now to FIG. 3, the upper extremity of portion 92 of the lower hanger element 86 projects upwardly into a recess 99 in upper hanger part 88. An adjusting screw 100 is threadedly connected to lower hanger element 86 as seen in FIG. 3, with the end of the screw engageable at 101 with a wall surface 102 formed in part 88 at the front of recess 99 to adjust the orientation of element 86 relative to element 88 and thereby level the tool. Screw 100 may extend through rod 93 and engage it threadedly at 103, with the screw being spaced slightly from unthreaded bores in part 92 at 104 and 105, and with a jamb nut 106 being tightenable against a transverse face 107 formed on part 92 to frictionally lock the screw 100 in any desired set position.

The two body members 15 and 16 of the tool are suspended from the opposite end portions 98 respectively of rod 93 by two shiftable preferably identical connector parts 108 and 109. The parts may contain tubular bushings 110 received about the externally cylindrical portions 98 of rod 93 and movable axially therealong between the full line positions of FIG. 4 and the broken line positions of that figure. This movement may be limited by provision of stop shoulders at the outer ends of portions 98 typically formed by locating circular washers 111 about reduced diameter threaded ends 112 of rod 93 and retaining those washers rigidly in place on the rod by nuts 113.

At their lower ends, the two parts 108 and 109 are connected pivotally to body members 15 and 16 of the spinner in a manner allowing the body members to pivot relative to elements 108 and 109 about axes 24 and 28. For this purpose, each element 108 and 109 has a lower externally cylindrical enlarged diameter portion 114 received rotatably within a cylindrical recess 115 formed in the upper end of an insert 116 connected into a cylindrical bore 117 in the upper portion of the corresponding body member. A top plate 118 is connected to the upper side of the body member by screws 119 (FIG. 2) and contains a circular opening 120 within which a reduced diameter cylindrical portion 121 of the part 108 or 109 is received and rotatable. Upward forces for suspending the tool are transmitted from part 108 or 109 to the corresponding top plate 118 by engagement of an upper annular horizontal shoulder 122 on part 108 or 109 with the underside of plate 118, while downward movement of the part 108 or 109 is limited by engagement of its horizontal undersurface 123 with an upwardly facing shoulder 124 formed in insert 116.

In order to prevent rotation of the two body sections 15 and 16 and carried parts about horizontal axis 95 relative to the suspending rod 93, the part 92 of hanger element 86 has a portion 125 (FIG. 3) projecting downwardly beneath rod 93 and containing a semicircular downwardly facing recess 226 at its lower end within which the outer cylindrical surface of bushing 57 about shaft 52 is rotatably received. This interfitting relationship between element 86 and shaft 52 thus maintains the tool against tilting movement from a desired level condition in which body members 15 and 16 extend directly horizontally for proper engagement with a directly vertical well pipe.

Actuating unit 31 for pivoting body sections 15 and 16 between their active and released positions preferably takes the form of a bellows assembly interposed between the outer ends of the body sections and urging them relatively apart. The bellows assembly may include several annular bellows elements 126 (typically three as shown) bonded or otherwise secured annularly in sealed relation to intermediate rings 127 and to the previously mentioned end plates 39 attached to sections 15 and 16. These various parts all form together a single bellows assembly containing an inner chamber for receiving pressurized air or other actuating fluid and adapted to expand along an axis 128 (FIG. 2) when pressurized to force the roller carrying ends of body sections 15 and 16 against the pipe. When the pressure within the bellows is released, the right ends of body parts 15 and 16 as viewed in FIG. 2 are returned toward one another by a coil spring 129, whose ends are connected to parts 15 and 16 respectively and which is at all times under tension to urge the right ends of parts 15 and 16 together. A manually actuated valve 130 controls delivery of pressurized fluid to the bellows and discharge of the pressurized fluid therefrom.

In placing the spinner in use, the tool may first be suspended from line 26 as illustrated in FIG. 1, and be retained against rotation about the well pipe axis by connection of a line 131 to portion 32 of one of the body sections, after which screw 100 may be adjusted as necessary to maintain the tool in a directly horizontal position with the screw being locked in its set position by jamb nut 106. Valve 130 is actuated to a condition in which it relieves fluid pressure from the interior of bellows structure 31, to enable spring 129 to pull the right end portions of body sections 15 and 16 as seen in FIG. 2 relatively toward one another and thus spread the rollers 18 and 19 apart so that the tool can be moved to a position about the well pipe. Valve 130 may then be actuated to apply fluid pressure to the interior of the bellows assembly 31, and spread the right ends of body sections 15 and 16 apart causing their left ends and rollers 18 and 19 to move toward one another into tight gripping engagement with the well pipe. Valve 45 is then actuated to a condition causing rotation of motors 22 in a predetermined direction for spinning the pipe either to connect section 11 to section 14 or unscrew the sections as desired. After the threaded connection has been made or broken as desired, valve 45 is actuated to stop the motors and valve 130 is operated to release the pressure to the bellows and enable the roller carrying ends of the body sections to open under the influence of spring 129 until the next successive spinning operation. The reversibility of motors 22 enables pipe to be spun in either direction for either connecting or disconnecting two pipe sections.

If the device is to be utilized on a different size pipe, the operator pulls the inner shaft assembly 72 within adjusting screw 52 from its FIG. 4 position to its FIG. 5 position, swinging outer section 76 of that assembly 72 to its FIG. 5 condition in which it can be utilized as a handle to rotate the screw in either direction to a new setting.

The screw turns, its right-hand and left-hand engagement with the two nut elements 47 and 50 causes those nut elements to be shifted either toward or away from one another to new relative settings in which the pivotal axes 24 and 28 of the connections between those nut elements and the two body sections 15 and 16 are a desired distance apart. The body sections shift with the nut elements, as do connector parts 108 and 109. These connector parts shift to new positions along portions 98 of rod 93 as the body sections move toward or away from one another, so that in any position to which the nut elements, body sections and parts 108 and 109 are moved the pivotal connections between elements 108 and 109 and the corresponding body sections remain aligned with the pivotal axes 24 and 28 about which the body sections pivot relative to the nut elements. The hanger structure 25 thus always suspends the body members and nut elements and carried parts at essentially the locations of the pivotal axes 24 and 28 about which the body members swing in gripping and releasing a pipe.

In any of the various settings of the adjustable connection 29 formed by adjusting screw 52 and nut elements 47 and 50, the entire spinner tool is suspended from hanger structure 25 in an effectively balanced horizontal condition. Regardless of the spacing between axes 24 and 28 to which the adjustable connection is set, the two pivotal connections 23 and 27 and their axes 24 and 28 are offset equal distances in opposite directions from the central vertical plane 17 in which hanger elements 86 and 88 and the suspension line 26 effectively lie, and by virtue of the symmetry of the entire tool with respect to the hanger assembly. In the properly balanced horizontal or level condition of the tool, the point 91 from which the upper hanger element and thus the tool are suspended is directly above the center of gravity 132 of the entire tool. Screw 100 of FIG. 3 is adjusted to attain this positioning of the suspension point 91 relative to the center of gravity. Because the center of gravity is to the right of the hanger element, the weight of the two body members 15 and 16 and carried parts applies force in a direction urging the end 101 of screw 100 against wall 102 of upper hanger part 88 so that adjustment of this single screw can attain the desired function of leveling the tool.

While a certain specific embodiment of the present invention has been disclosed as typical, the invention is of course not limited to this particular form, but rather is applicable broadly to all such variations as fall within the scope of the appended claims.

We claim:

1. A pipe spinner comprising:

a plurality of rollers engageable with a pipe at different locations about its periphery and adapted to grip and spin the pipe;

two body members having portions receivable at different sides of said pipe and each carrying at least one of said rollers;

two pivotal connections mounting said body members for swinging movement about two spaced axes respectively between a closed position in which the rollers grip and drive a pipe and an open position releasing the pipe;

an adjustable connection having a portion extending between said pivotal connections, said adjustable connection being operable to shift said pivotal axes toward and away from one another to differently spaced relative positions to grip and drive different sizes of pipe;

powered means for swinging said body members about said axes and between open and closed positions in differently spaced conditions of said axes; and support means adapted for connection to and support by a suspending element and having portions which extend toward said two axes respectively and which suspend said body members and pivotal connections at essentially the locations of said two pivotal axes in any of said differently spaced relative positions of the axes without transmission of the suspension force through said portion of the adjustable connection which extends between said pivotal connections.

2. A pipe spinner as recited in claim 1, in which said adjustable connection includes two threads which engage one another and are relatively adjustable to shift one of said axes toward and away from the other.

3. A pipe spinner as recited in claim 1, in which said portion of the adjustable connection which extends between said pivotal connection includes a threaded shaft operable by rotation to shift the two pivotal connections toward and away from on another.

4. A pipe spinner as recited in claim 1, in which said support means and said portions thereof extending toward said two pivotal axes are spaced above said portion of the adjustable connection which extends between said pivotal connections.

5. A pipe spinner as recited in claim 1, in which said two members are connected to said portions of said support means for pivotal movement relative to said portions about said two axes.

6. A pipe spinner as recited in claim 1, in which said support means have a portion acting against said portion of the adjustable connection in a relation maintaining said body members against swinging movement about a horizontal axis relative to said support means and from a predetermined essentially level condition.

7. A pipe spinner comprising:

a plurality of rollers engageable with a pipe at different locations about its periphery and adapted to grip and spin the pipe;

two body member having portions receivable at different sides of said pipe and each carrying at least one of said rollers;

two pivotal connections mounting said body members for swinging movement about two spaced axes respectively between a closed position in which the rollers grip and drive a pipe and an open position releasing the pipe;

two nut elements attached to said two pivotal connections respectively and having right-hand and left-hand threads respectively;

a threaded shaft structure having right-hand and left-hand threads engaging said two nut elements respectively in a relation moving said nut elements and the axes of said two pivotal connections toward and away from one another to differently spaced relative positions in response to rotation of said shaft structure in opposite directions;

powered means for swinging said body members about said two axes and between open and closed positions in said differently spaced positions of said axes;

motor means operable to drive at least one of said rollers rotatively and thereby turn the pipe in said differently spaced positions of said axes; and a support structure adapted for connection to a suspending element and having portions which extend toward said two axes respectively at locations offset from said shaft structure and which suspend said body members and pivotal connections at essentially the locations of said two pivotal axes respectively in any of said differently spaced relative positions of the axes without transmission of the suspension forces through said shaft structure.

8. A pipe spinner as recited in claim 7, in which said body members are connected to said portions of said support structure for pivotal movement of the body members relative to said portions about said pivotal axes.

9. A pipe spinner as recited in claim 7, in which said portions of said support structure extend toward said pivotal axes at a location spaced above said threaded shaft structure.

10. A pipe spinner as recited in claim 7, in which said support structure has a portion applying force to said threaded shaft structure in a relation preventing swinging movement of said body members relative to said support structure from a predetermined essentially level condition.

11. A pipe spinner as recited in claim 7, in which said support structure is located above said threaded shaft structure and has a projection extending downwardly to a location applying force to said shaft structure in a relation preventing swinging movement of said body members relative to said support structure from a predetermined essentially level condition.

12. A pipe spinner comprising:

a plurality of rollers engageable with a pipe at different locations about its periphery and adapted to grip and spin the pipe;

two body members having portions receiveable at different sides of said pipe and each carrying at least one of said rollers;

two nut elements having right-hand and left-hand threads respectively and connected pivotally to said body members respectively in a relation mounting the body members for swinging movement relative to the nut elements about two spaced axes respectively between a closed position in which the rollers grip and drive a pipe and an open position releasing the pipe;

a threaded shaft structure having right-hand and left-hand threads engaging said two nut elements respectively in a relation moving said nut elements and said pivotal axes toward and away from one another to differently spaced relative positions in response to rotation of said shaft structure in opposite directions;

powered means for swinging said body members about said two spaced axes and between open and closed positions in said differently spaced positions of said axes;

motor means operable to drive at least one of said rollers rotatively and thereby turn the pipe in said differently spaced positions of said axes;

a support part adapted to be connected to a suspending element and having projections extending laterally in different directions toward said two axes respectively;

two additional parts connected to said projections respectively for horizontal sliding movement relative thereto and located above and aligned with said nut elements respectively; and pivotal connections suspending said two body members from said two additonal parts respectively and mounting the two body members for pivotal movement relative to said additional parts about said two pivotal axes respectively.

13. A pipe spinner as recited in claim 12, including a third projection extending downwardly from said support part and extending at least partially about said threaded shaft structure at a location between said nut elements in a relation retaining said body members against swinging movement relative to said support part about an essentially horizontal axis from a predetermined essentially level condition.

14. A pipe spinner comprising:

a plurality of rollers engageable with a pipe at different locations about its periphery and adapted to grip and spin the pipe;

two parts having portions receivable at different sides of said pipe and each carrying at least one of said rollers;

a pivotal connection mounting one of said parts for swinging movement about a predetermined axis between a closed position in which the rollers grip and drive a pipe and an open position releasing the pipe;

an adjustable connection attaching said pivotal connection to the other of said parts for relative lateral adjusting movement in a relation shifting said pivotal axis relative to said other part to grip and drive different sizes of pipe;

powered means for swinging said one part about said pivotal axis in differently adjusted conditions relative to said other part;

said adjustable connection including a shaft operable by rotation to shift said pivotal axis relative to said other part; and a manual actuator assembly receivable within an axially extending passage in said shaft and adapted to be withdrawn axially relative thereto to an outwardly projecting position and including a first part having an externally non-circular portion engaging an internally non-circular portion of said shaft in a relation to transmit rotary motion thereto, and a handle part connected pivotally to said first part for swinging movement to a position of extension laterally therefrom when said assembly is withdrawn to said outwardly projecting position.

15. A pipe spinner as recited in claim 14, in which said shaft has external right and left-hand threads, and said adjustable connection includes two nuts having right and left-hand threads engaging said threads of the shaft to actuate the nuts toward and away from one another upon rotation of the shaft.

16. A pipe spinner comprising:

a plurality of rollers engageable with a pipe at different locations about its periphery and adapted to grip and spin the pipe;

two body members having portions receivable at different sides of said pipe and each carrying at least one of said rollers;

two pivotal connections mounting said body members for swinging movement about two spaced axes respectively between a closed position in which the rollers grip and drive a pipe and an open position releasing the pipe;

an adjustable connection having a portion extending between said pivotal connections, said adjustable connection being operable to shift said pivotal axes toward and away from one another to differently spaced relative positions to grip and drive different sizes of pipe;

powered means for swinging said body members about said axes and between open and closed positions in differently spaced conditions of said axes; and support means adapted for connection to and support by a suspending element and having portions which extend toward said two axes respectively at locations offset from said portion of the adjustable connection extending between said pivotal connections and which suspend said body members and pivotal connections at essentially the locations of said two pivotal axes in any of said differently spaced relative positions of the axes;

said portions of said support means including a first part suspended by said element and a second part pivotally carrying one of said body members and supported by said first part but movable relative thereto in correspondence with said movement of said two axes toward and away from one another.

17. A pipe spinner comprising:

a plurality of rollers engageable with a pipe at different locations about its periphery and adapted to grip and spin the pipe;

two body members having portions receivable at different sides of said pipe and each carrying at least one of said rollers;

two pivotal connections mounting said body members for swinging movement about two spaced axes respectively between a closed position in which the rollers grip and drive a pipe and an open position releasing the pipe;

an adjustable connection having a portion extending between said pivotal connections, said adjustable connection being operable to shift said pivotal axes toward and away from one another to differently spaced relative positions to grip and drive different sizes of pipe;

powered means for swinging said body members about said axes and between open and closed positions in differently spaced conditions of said axes; and a hanger part adapted to be supported by a suspending element;

projections on said hanger part extending in different directions toward said two axes respectively; and additional parts supporting said two body members for relative pivotal movement about said two axes and slidable along said projections to different positions in correspondence with movement of said axes toward and away from one another.

18. A pipe spinner comprising:

a plurality of rollers engagable with a pipe at different locations about its periphery and adapted to grip and spin the pipe;

two body members having portions receivable at different sides of said pipe and each carrying at least one of said rollers;

two pivotal connections mounting said body members for swinging movement about two spaced axes respectively between a closed position in which the rollers grip and drive a pipe and an open position releasing the pipe;

two nut elements attached to said two pivotal connections respectively and having right-hand and left-hand threads respectively;

a threaded shaft structure having right-hand and left-hand threads engaging said two nut elements respectively in a relation moving said nut elements and the axes of said two pivotal connections toward and away from one another to differently spaced relative positions in response to rotation of said shaft structure in opposite directions;

powered means for swinging said body members about said two axes and between open and closed positions in said differently spaced positions of said axes;

motor means operable to drive at least one of said rollers rotatively and thereby turn the pipe in said differently spaced positions of said axes; and a support structure adapted for connection to a suspending element and having portions which extend toward said two axes respectively at locations offset from said shaft structure and which suspend said body members and pivotal connections at essentially the locations of said two pivotal axes respectively in any of said differently spaced relative positions of the axes;

one of said portions of said support structure including a part suspended by said said element and a structure pivotally carrying one of said body members and supported by said part but shiftable generally horizontally relative thereto in correspondence with said movement of said axes toward and away from one another.

19. A pipe spinner comprising:

a plurality of rollers engageable with a pipe at different locations about its periphery and adapted to grip and spin the pipe;

two body members having portions receivable at different sides of said pipe and each carrying at least one of said rollers;

two pivotal connections mounting said body members for swinging movement about two spaced axes respectively between a closed position in which the rollers grip and drive a pipe and an open position releasing the pipe;

two nut elements attached to said two pivotal connections respectively and having right-hand and left-hand threads respectively;

a threaded shaft structure having right-hand and left-hand threads engaging said two nut elements respectively in a relation moving said nut elements and the axes of said two pivotal connections toward and away from one another to differently spaced relative positions in response to rotation of said shaft structure in opposite directions;

powered means for swinging said body members about said two axes and between open and closed positions in said differently spaced positions of said axes;

motor means operable to drive at least one of said rollers rotatively and thereby turn the pipe in said differently spaced positions of said axes;

a part adapted to be supported by a suspending element;

projections extending in different directions from said part and toward said axes; and structures movably supported by said projections and slidable therealong and suspending said body members for relative pivotal movement about said two axes respectively.

* * * * *